US010029458B2

(12) United States Patent
Hogan et al.

(10) Patent No.: US 10,029,458 B2
(45) Date of Patent: Jul. 24, 2018

(54) METHOD OF GENERATING PRINT DATA FOR INKJET PRINTHEAD

(71) Applicant: Memjet Technology Ltd., Dublin (IE)

(72) Inventors: Julie Hogan, Dublin (IE); Angus North, North Ryde (AU); Philip Palma, North Ryde (AU); John Sheahan, North Ryde (AU); Brian Brown, North Ryde (AU); David Keeshan, North Ryde (AU); Rodney Hardy, North Ryde (AU); Peter Allworth, North Ryde (AU); Colin Pickup, North Ryde (AU); Caitriona Forbes, Dublin (IE); Kieran Roughan, Dubin (IE); William Jacob, Dublin (IE)

(73) Assignee: Memjet Technology Ltd. (IE)

( * ) Notice: Subject to any disclaimer, the term of this patent is extended or adjusted under 35 U.S.C. 154(b) by 0 days.

(21) Appl. No.: 15/374,980

(22) Filed: Dec. 9, 2016

(65) Prior Publication Data

US 2017/0120581 A1 May 4, 2017

Related U.S. Application Data

(63) Continuation of application No. 14/328,520, filed on Jul. 10, 2014, now Pat. No. 9,545,787, and a continuation-in-part of application No. 14/190,869, filed on Feb. 26, 2014, now Pat. No. 9,079,403, which is a continuation of application No. 13/615,127, filed on Sep. 13, 2012, now Pat. No. 8,702,206.

(60) Provisional application No. 61/537,063, filed on Sep. 21, 2011, provisional application No. 61/858,265, filed on Jul. 25, 2013.

(51) Int. Cl.
*B41J 2/045* (2006.01)

(52) U.S. Cl.
CPC ..... *B41J 2/04553* (2013.01); *B41J 2/04586* (2013.01)

(58) Field of Classification Search
CPC .... B41J 2/04541; B41J 2/0457; B41J 2/0458; B41J 2/145; B41J 2/04586; B41J 2/04553
See application file for complete search history.

(56) References Cited

U.S. PATENT DOCUMENTS 7,585,045 B2 * 9/2009 Yamanobe ..... B41J 2/2125 347/19
9,061,496 B2 * 6/2015 Shimomura ..... B41J 2/135

* cited by examiner

*Primary Examiner* — Lamson Nguyen
(74) *Attorney, Agent, or Firm* — Cooley LLP

(57) ABSTRACT

A method of generating print data for an inkjet printhead having a plurality of ink planes. The method includes the steps of: receiving image data for a print job in a printer controller; retrieving keep-wet pattern data for each ink plane of the printhead, the retrieved keep-wet pattern data being determined using one or more input parameters; generating first print data for each ink plane in the printer controller based on the received image data; merging the first print data with the keep-wet pattern data to provide second print data for each ink plane; and sending the second print data from the printer controller to the printhead, thereby causing the printhead to print an image together with a keep-wet pattern. The keep-wet pattern is defined by a plurality of dots printed at a frequency sufficient to maintain hydration of each nozzle in the printhead.

8 Claims, 5 Drawing Sheets

METHOD OF GENERATING PRINT DATA FOR INKJET PRINTHEAD

CROSS-REFERENCE TO RELATED APPLICATIONS

This application is a continuation of U.S. patent application Ser. No. 14/328,520, entitled METHOD OF GENERATING PRINT DATA FOR INKJET PRINTHEAD, filed Jul. 20, 2014, which claims priority under 35 U.S.C. § 119(e) to U.S. Provisional Patent Application No. 61/858,265, filed Jul. 25, 2013, and is a continuation-in-part of U.S. application Ser. No. 14/190,869, entitled INKJET PRINTER HAVING PRINTHEAD PLUMBED FOR OPTIMIZED COLOR MIXING, filed on Feb. 26, 2014, which is a continuation of U.S. application Ser. No. 13/615,127, entitled PRINTER FOR MINIMIZING ADVERSE MIXING OF HIGH AND LOW LUMINANCE INKS AT NOZZLE FACE OF INKJET PRINTHEAD, filed on Sep. 13, 2012, now issued as U.S. Pat. No. 8,702,206, which claims priority under 35 U.S.C. § 119(e) to U.S. Provisional Patent Application Ser. No. 61/537,063, entitled INKS AND PRINTHEADS, filed on Sep. 21, 2011, the disclosures of each of which are incorporated by reference in their entirety for all purposes.

FIELD OF THE INVENTION

This invention relates to a method of printing and a printer controller for generating print data for a printhead. It has been developed primarily for maintaining hydration of nozzles in an inkjet printhead with minimal visual impact.

BACKGROUND OF THE INVENTION

Inkjet printers employing Memjet® technology are commercially available for a number of different printing formats, including home-and-office ("SOHO") printers, label printers and wideformat printers. Memj et® printers typically comprise one or more stationary inkjet printheads, which are user-replaceable. For example, a SOHO printer or a benchtop label printer comprises a single user-replaceable multicolor (polychrome) printhead; a high-speed web printer comprises a plurality of user-replaceable monochrome printheads aligned along a media (web) feed direction (see, for example, US2012/0092403 and U.S. Pat. No. 8,398,231); and a wideformat printer comprises a plurality of user-replaceable multicolor printheads in a staggered overlapping arrangement so as to span across a wideformat pagewidth (see U.S. Pat. No. 8,388,093).

Inkjet nozzles must be maintained in a hydrated state in order to function properly. If nozzle is not fully hydrated, the nozzle tends to become clogged with ink ("decapped") and may be unable to eject a droplet of ink in response to a fire signal. Even if a dehydrated nozzle is still able to eject ink in response to a fire signal, the ejected droplet may be misdirected, have a reduced droplet volume or a reduced ejection velocity if not fully hydrated, any of which may lead to a reduction in print quality. The problem of nozzle dehydration is particularly exacerbated in Memjet® printers, which generally have low droplet volumes (e.g. 1-3 pL) and dendritic ink supply channels.

Inkjet printers usually employ various strategies for unclogging nozzles or restoring nozzles to a fully hydrated state. Typically, this involves a maintenance cycle which may comprise wiping, forced ink purging (e.g. by a applying a vacuum to the nozzle plate or a positive pressure to the ink supply) and firing ink droplets into a spittoon ("spitting"). Spitting may involve increasing the usual droplet ejection energy to force ink from nozzles (see, for example, US 2011/0310149, the contents of which are incorporated herein by reference). Spitting may be performed during a maintenance cycle or between media sheets during a print job.

Inkjet printers may additionally employ various strategies for maintaining nozzles in a hydrated state and, thereby minimizing the frequency of maintenance interventions required. Maintenance interventions for restoring nozzles to a functioning state are time-consuming and wasteful of ink and should be avoided as far as possible. Maintenance inventions are potentially problematic when printing onto a media web, because a conventional maintenance station cannot cross the media path without cutting the web. Moreover, between-page spitting is not an option when printing onto a continuous media web.

One strategy for minimizing clogging of non-firing nozzles uses sub-ejection pulses which have insufficient energy to eject a droplet of ink, but sufficient energy to warm the ink inside the nozzle chamber and thereby reduce its viscosity. The use of sub-ejection pulses in this manner is described in U.S. Pat. No. 7,845,747, the contents of which are incorporated herein by reference.

Another strategy for minimizing clogging of nozzles is to ensure that each nozzle of the printhead is fired periodically so that the ink inside the nozzle chamber is continuously refreshed and does not have an opportunity to dehydrate. U.S. Pat. No. 7,246,876, the contents of which are incorporated herein by reference, describes printing a low-density keep-wet pattern onto a media substrate to ensure that each nozzle of the printhead is fired within a time period which is less than a decap time of the nozzle. Typically, the density of dots on the media substrate by virtue of the keep-wet pattern is less than 1:250 and not clustered so as to minimize visibility.

Keep-wet patterns are potentially an important strategy for maintaining good print quality in inkjet printers, especially inkjet web printers, where this no opportunity for between-page spitting and less opportunity for maintenance interventions. However, keep-wet patterns paradoxically reduce print quality by printing additional dots, which are not part of the image data sent to the printer. It would therefore be desirable to minimize the visibility of keep-wet patterns and further improve print quality, especially in inkjet web printers which cannot perform between-page spitting.

SUMMARY OF THE INVENTION

In a first aspect, there is provided a method of generating print data for an inkjet printhead having a plurality of ink planes, the method comprising the steps of:

receiving image data for a print job in a printer controller;

retrieving keep-wet pattern data for each ink plane of the printhead, the retrieved keep-wet pattern data being determined using one or more input parameters;

generating first print data for each ink plane of the printhead in the printer controller based on the received image data;

merging the first print data with the keep-wet pattern data to provide second print data for each ink plane of the printhead; and sending the second print data, or third print data based on the second print data, from the printer controller to the printhead, thereby causing the printhead to print an image together with a keep-wet pattern, wherein the keep-wet pattern is defined by a plurality of dots printed at a frequency sufficient to maintain hydration of each nozzle in the printhead The method according to the first aspect advantageously minimizes the visibility of the printed keep-wet pattern by tailoring the keep-wet pattern ejected from each ink plane of the printhead in accordance with parameter(s) relating to the print job. In this way, the frequency of keep-wet drops ejected from each ink plane can be kept to an absolute minimum, which significantly reduces the overall visibility of the keep-wet pattern.

Preferably, at least one ink plane ejects a different keep-wet pattern than at least one other ink plane of the printhead. In some embodiments, each ink plane may eject a different keep-wet pattern.

Preferably, the step of merging the first print data with the keep-wet pattern data comprises ORing the first print data with the keep-wet pattern data.

Preferably, the method includes the step of applying an offset to the keep-wet pattern data before merging with the first print data. In other words, first keep-wet pattern data retrieved by the printer controller is transformed into second keep-wet pattern data for merging with the first print data by applying the offset.

Preferably, a different offset is applied for different pages, such that sequential pages in a print job are not printed with the same keep-wet pattern. The offset therefore helps to minimize visible artifacts caused by repetition of the keep-wet pattern across many pages.

Preferably, the image data is received from a computer system programmed with a printer driver for the printhead.

In some embodiments, the printer controller (e.g. print engine controller chip) may retrieve the keep-wet pattern data from the printer driver. In other words, the printer driver generates the keep-wet pattern data using parameter(s) relating to the print job and sends the keep-wet pattern data together with the image data to the printer controller.

In other embodiments, the printer controller may comprise a memory storing a plurality of different keep-wet pattern data, and the keep-wet pattern data for each ink plane for a particular print job is retrieved from the memory. The printer controller may determine which keep-wet pattern data to employ based on parameter(s) relating to the print job. Alternatively, the printer driver may determine which keep-wet pattern data to employ and then send keep-wet pattern identifier(s) to the printer controller so as to enable the printer controller to retrieve the appropriate keep-wet pattern data from its memory for a particular print job.

Preferably, the keep-wet pattern data for each ink plane is determined using one or more parameters selected from:

a position of each ink plane in the printhead;

a print speed of the print job;

a type of ink printed from each ink plane (e.g. ink color, ink viscosity, colorant loading etc);

a type of print medium;

a length of the print job;

an ambient humidity;

an ambient temperature;

the image data;

optical interference (e.g. Moire interference) between keep-wet patterns printed from each ink plane; and a minimum print quality threshold.

Preferably, the keep-wet pattern data for each ink plane is determined using at least the following two parameters:

a position of each ink plane in the printhead (relative to the media feed direction); and a type of ink printed from each ink plane.

Preferably, the keep-wet pattern for each ink plane is determined by an algorithm, which weights the one or more parameter(s) to determine the keep-wet pattern.

Preferably, the algorithm is programmed into printer firmware (e.g. firmware in the print engine controller chip) or a printer driver running in a computer system connected to the printer.

Preferably, the keep-wet pattern for each ink plane comprises a pseudo-random pattern of dots.

Preferably, the plurality of dots defining the keep-wet patterns for different ink planes are not printed dot-on-dot (i.e. dot-off-dot). Avoiding dot-on-dot printing in the respective keep-wet patterns for different ink planes minimizes dot gain on the print medium and, therefore, minimizes visibility. Nevertheless, dot-on-dot printing of keep-wet patterns from different ink planes may be appropriate in some circumstances and the present invention is not limited to dot-off-dot printing.

Preferably, the dots defining the printed keep-wet pattern have a density of less than 1:1000, less than 1:5000 or less than 1:10000. In other words, the printed keep-wet pattern (from all ink planes) preferably has a coverage on the print media of less than 0.1%, less than 0.05% or less than 0.01%.

In another aspect, there is provided a printer controller for generating print data for an inkjet printhead, the printer controller being configured for:

receiving image data for a print job in a printer controller;

retrieving keep-wet pattern data for each ink plane of the printhead, the retrieved keep-wet pattern data being determined using one or more input parameters;

generating first print data for each ink plane of the printhead in the printer controller based on the received image data;

merging the first print data with the keep-wet pattern data to provide second print data for each ink plane of the printhead; and sending the second print data, or third print data based on the second print data, from the printer controller to the printhead, thereby causing the printhead to print an image together with a keep-wet pattern.

In a second aspect, there is provided a method of printing from a fixed inkjet printhead having a plurality of ink planes, the method comprising the steps of:

feeding a print medium past the printhead in a media feed direction, the media feed direction defining relative upstream and downstream sides of the printhead;

printing an image onto the print medium, the image being defined by image data; and printing a keep-wet pattern onto the print medium from each ink plane of the printhead, the keep-wet pattern being defined by a plurality of dots printed at a frequency sufficient to maintain hydration of each nozzle in the printhead, wherein a first keep-wet pattern from a first ink plane is printed at a higher frequency than a second keep-wet pattern from a second ink plane, the first ink plane being furthest upstream in the printhead.

The method according to the second aspect makes use of the relatively more dehydrating local environment of an upstream ink plane compared to a downstream ink plane in an inkjet printhead. This is particularly useful in monochrome printheads, which are used in high-speed web printers, such as those described in US 2012/0092403, the contents of which are herein incorporated by reference. However, the method according to the second aspect may also be used in multi-color printheads.

Generally, an air flow generated by print media in the media feed direction tends to buffet the ink plane positioned furthest upstream in the printhead and has a relatively greater dehydrating effect on those nozzles. Accordingly, the upstream nozzles require more frequent droplet ejections to stay hydrated than those nozzles positioned further downstream relative to the media feed direction and airflow. The corollary is that the visibility of keep-wet patterns can be minimized by placing a low luminance color (e.g. yellow) in the furthest upstream ink plane. Printing yellow ink at a relatively high keep-wet frequency has a much lower visual impact than printing, for example, black or magenta at the same keep-wet frequency.

Preferably, each ink plane comprises one or more nozzle rows, each nozzle row within the same ink plane being supplied with the same ink. Typically, each ink plane comprises a pair or nozzle rows for printing even and odd dots in a line of print. The ink planes of the printhead may all eject the same colored ink, in the case of monochrome printhead. Alternatively, at least one ink plane may eject a different colored ink than at least one other ink plane, in the case of a multi-color printhead.

Typically, neighboring ink planes are spaced apart from each other by a distance in the range of about 20 to 1000 microns, or 30 to 500 microns or 50 to 100 microns.

Preferably, each nozzle of the printhead fires at a frequency of greater than 0.5 Hz during each print job (e.g. 1 to 20 Hz). The minimum firing frequency of each nozzle is assured by virtue of printing the image and/or by virtue of printing the keep-wet pattern coextensive with the image.

Preferably, the keep-wet pattern comprises a pseudo-random pattern of dots which is substantially invisible to an unaided human eye. The particular pattern used for each ink plane and for each print job may be varied in order to minimize, as far as possible, the overall visual impact of the keep-wet pattern.

Preferably, the printhead comprises a third ink plane positioned between the first and second ink planes, the third ink plane printing a third keep-wet pattern. The printhead may further comprise, fourth, fifth and/or sixth ink planes positioned between the first and second ink planes. Those ink planes positioned between the first and second ink planes are generally referred to as 'middle' ink planes. Typically, the printhead comprises four or five ink planes, although it will be appreciated that the number of ink planes in one printhead is not particularly limited.

Preferably, the second keep-wet pattern is printed at a lower frequency than the first keep-wet pattern.

Preferably, the third keep-wet pattern is printed at a lower frequency than the first keep-wet pattern.

Preferably, the third keep-wet pattern is printed at a lower frequency than the first and second keep-wet patterns.

Generally, those ink planes which are flanked on either side by neighboring ink planes benefit from the local hydrating effect of the neighboring ink planes. Moreover, the upstream ink plane(s) tend to shield downstream ink plane(s) from the airflow. Accordingly, the middle ink plane(s)—that is those ink plane(s) positioned between the furthest upstream and furthest downstream ink planes—usually require the least frequent keep-wet patterns, because they benefit both from the shielding effects of upstream ink plane(s) and the local hydrating effects of a pair of neighboring ink planes. The furthest downstream ink plane benefits from the shielding effect, but not the same local hydrating effect as the middle ink plane(s). Accordingly, the furthest downstream ink plane usually requires a keep-wet frequency which is greater than the middle ink planes, but less than the further upstream ink plane. The corollary is that the visibility of keep-wet patterns can be minimized by placing a high luminance color (e.g. black) in the middle ink plane(s) and a low luminance color (e.g. yellow) in the furthest upstream ink plane.

Analogously, a printer comprised of multiple aligned monochrome printheads advantageously benefits from a printhead ejecting a lowest luminance ink (e.g. yellow) as a furthest upstream printhead and, still further advantageously, a printhead ejecting a highest luminance ink (e.g. black) as a middle printhead.

Accordingly, in a third aspect, there is provided a multi-color printer comprised of an array of monochrome fixed inkjet printheads aligned in a media feed direction, the printer comprising:

a first printhead positioned furthest upstream relative to the media feed direction;

a second printhead positioned furthest downstream relative to the media feed direction; and a third printhead positioned between the first and second printheads, wherein each printhead is supplied with a respective ink from a multi-color ink set, and wherein the first printhead is supplied with a lowest luminance ink of the ink set and the third printhead is supplied with a highest luminance ink of the ink set.

In the printer according to the third aspect, neighboring printheads are generally spaced apart from each other by a distance of the order of centimeters as opposed to an ink plane spacing of the order of microns. Typically, neighboring printheads are spaced apart from each other by a distance of 2 to 50 cm, 3 to 30 cm or 5 to 20 cm. Therefore, the shielding and local hydrating effects described above are less pronounced in the printer in respect of neighboring printheads as opposed to neighboring ink planes. Nevertheless, there is still an appreciable benefit in arranging the printheads such that the printhead ejecting the lowest luminance ink is positioned furthest upstream in the array, since this printhead receives the greatest buffeting from the air flow generated by the print media and is, therefore, positioned in the most dehydrating environment of the array.

Preferably, the first printhead is supplied with yellow ink.

Preferably, the third printhead is supplied with black ink.

Preferably, one or more other printheads are positioned between the first and second printheads. Thus, the printer may be comprised of 4 or more printheads.

Preferably, the printer further comprises a feed mechanism for feeding a web of print media past each of the printheads in the media feed direction. Preferably, the feed mechanism is configured to feed the web of print media at a speed of greater than 0.5 meters per second, greater than 1 meter per second or greater than 2 meters per second.

Preferably, the printer further comprises one or more printer controllers programmed to send print data to each of the plurality of printheads, the print data configuring the printheads to print a respective keep-wet pattern onto print media, wherein each keep-wet pattern is defined by a plurality of dots printed at a frequency sufficient to maintain hydration of each nozzle of a respective printhead.

Preferably, all nozzles of the first printhead are configured to print a first keep-wet pattern at a first average frequency, all nozzles of the second printhead are configured to print a second keep-wet pattern at a second average frequency, and all nozzles of the third printhead are configured to print a third keep-wet pattern at a third average frequency.

Preferably, the first average frequency is higher than the second average frequency.

Preferably, the first average frequency is higher than the third average frequency.

Preferably, the third average frequency is lower than the first and second average frequencies.

In a fourth aspect, there is provided a multi-color printer comprised of an array of monochrome fixed inkjet printheads aligned in a media feed direction, the printer comprising:

a first printhead positioned furthest upstream relative to the media feed direction;

a second printhead positioned furthest downstream relative to the media feed direction; and a third printhead positioned between the first and second printheads, wherein each printhead is supplied with a respective ink from a multi-color ink set, and wherein the third printhead is supplied with a highest luminance ink of the ink set.

BRIEF DESCRIPTION OF THE DRAWINGS

Embodiments of the present invention will now be described by way of example only with reference to the accompanying drawings, in which.

DETAILED DESCRIPTION OF THE INVENTION

Tailored Keep-Wet Pattern Per Ink Plane

Figure 1:
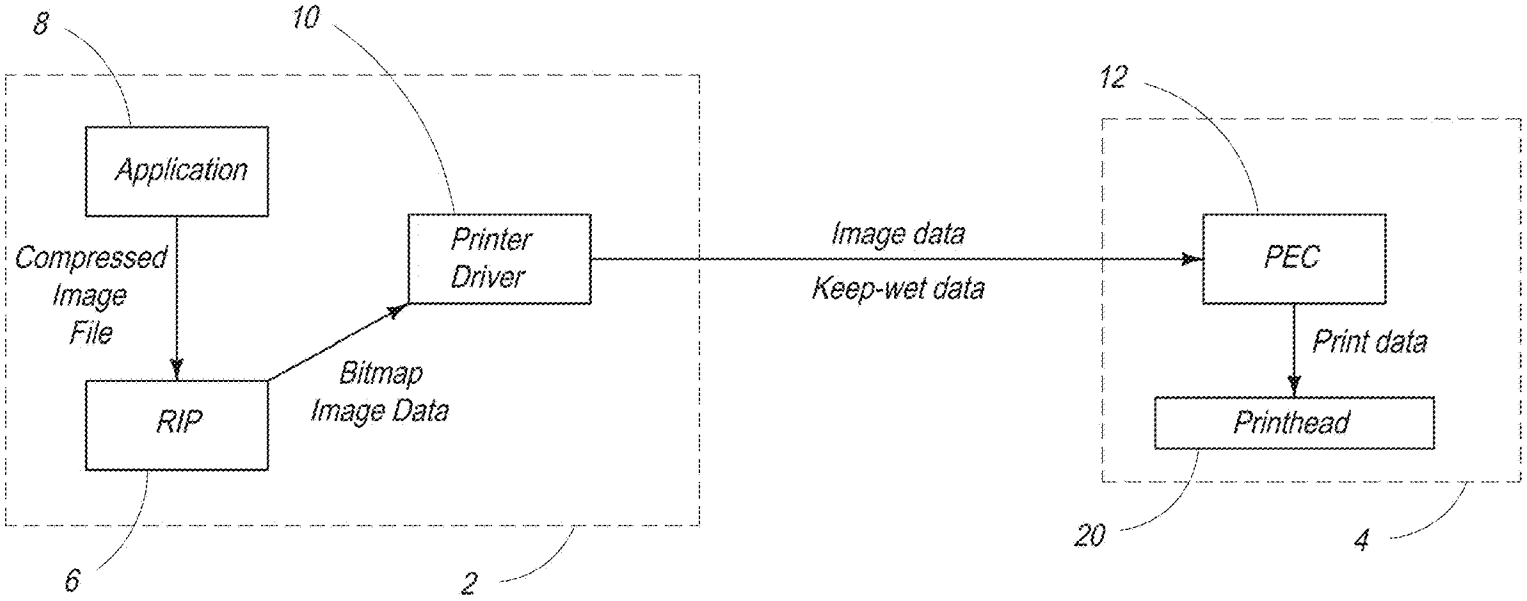
FIG. 1 shows data flow between a computer system and a printer.

Referring to FIG. 1, there is shown schematically a printing system having a specific architecture for implementing the method described in connection with the first aspect.

A computer system 2 communicates with a printer 4 via a suitable communications link, such as a wired or wireless connection. The computer system 2 comprises a raster image processor (RIP) 6 which receives a compressed image file from a suitable application 8 generating images to be printed. The compressed image file may be in any suitable image file format, such as PDF, JPEG, TIFF, GIF etc or any suitable page description language, such as a PostScript, PDL etc. The RIP 6 processes the compressed image data and sends bitmap image data to a printer driver 10. The printer driver 10 sends the bitmap image data together with keep-wet pattern data ("keep-wet data") for each ink plane of a printhead 20 to a print engine controller chip ("PEC") 12 of the printer 4. Determination of the appropriate keep-wet pattern data for each ink plane will be described in further detail below.

In an alternative architecture, the application 8 may send a compressed image file directly to the printer driver 10, which sends compressed image data to the PEC 12. In this alternative architecture, the PEC 12 decompresses the compressed image data to generate bitmap image data.

In a still further alternative architecture, the printer driver 10 may send a pattern identifier for each ink plane to the PEC 12 instead of actual keep-wet pattern data. In this alternative architecture, the PEC 12 retrieves keep-wet pattern data corresponding to each pattern identifier from a memory of the printer 4 (e.g. a memory in the PEC 12), which stores a plurality of different keep-wet pattern data, each being indexed with a respective pattern identifier.

In a still further alternative architecture, the printer driver 10 sends only image data to the PEC 12. In this alternative architecture, the PEC 12 (rather than the printer driver 10) determines appropriate keep-wet pattern data for each ink plane and retrieves these data from a memory.

From the foregoing, it will be appreciated that various alternative architectures will be readily apparent to the skilled person for implementing the present invention. The particular architecture shown in FIG. 1 is not limiting and has been shown for illustrative purposes only.

Figure 2:
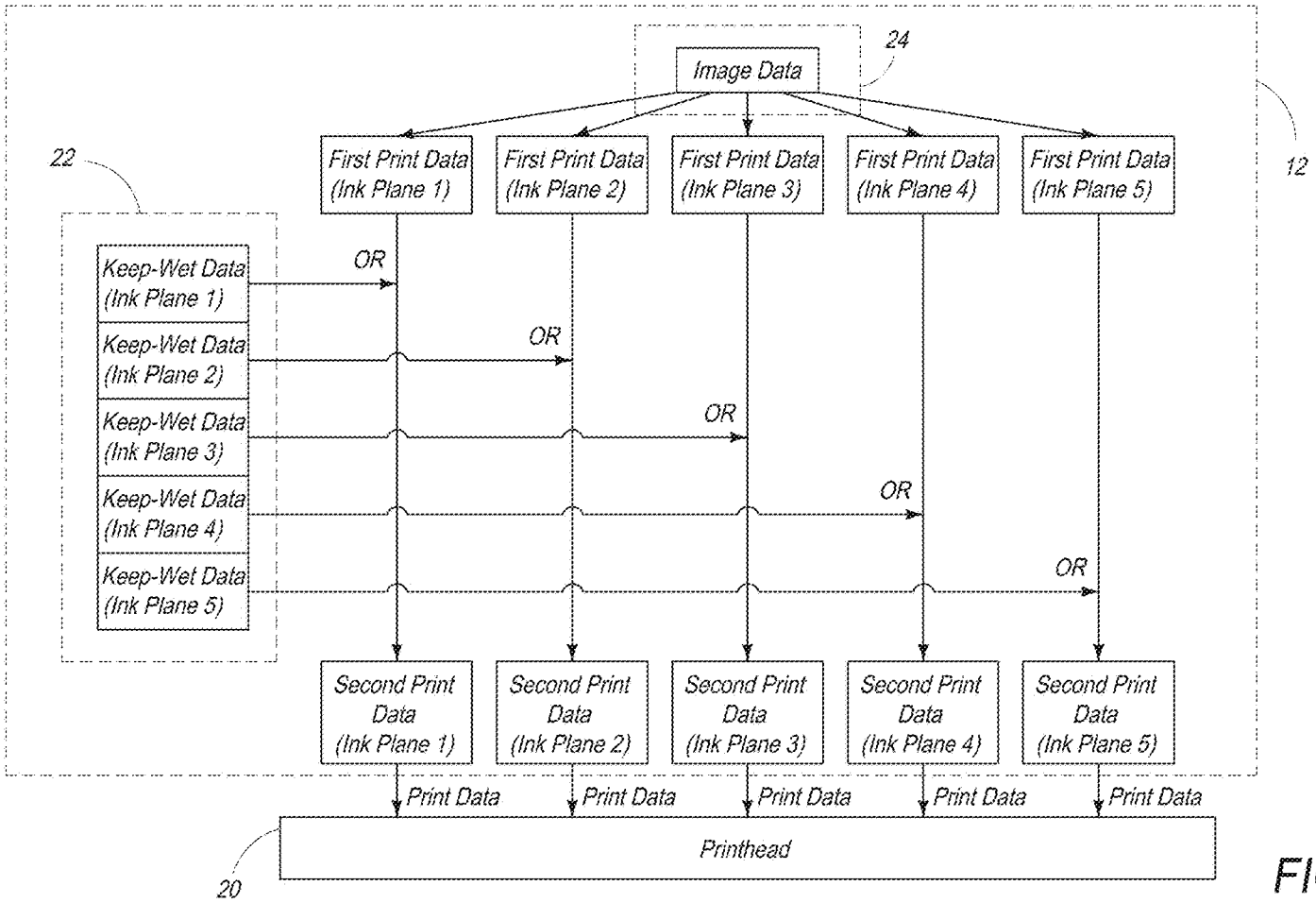
FIG. 2 shows data between a print engine controller chip (PEC) and a printhead.

Referring now to FIG. 2, the PEC 12 generates print data for each ink plane of the printhead 20. In this case, the printhead 20 has five ink planes, although it will be appreciated that the printhead may have any number of ink planes. The keep-wet data for each of the five ink planes, received from the printer driver 10, is loaded into a first writable memory 22 (e.g. RAM) of the PEC 12 while the image data is loaded into a second writable memory 24, which may be a same or different memory unit of the PEC. The image data is separated into the different ink planes and processed in the PEC to generate first print data for each ink plane. The first print data for each ink plane is merged (OR'd) with corresponding keep-wet data for that ink plane (by retrieving the corresponding keep-wet data from the first writable memory 22) to generate second print data. Finally, print data is sent to the printhead 20 for each ink plane. The second print data resulting from the merging step is usually processed further in the PEC 12 to generate third print data before being sent to the printhead 20. It will, of course be appreciated that FIG. 2 represents a simplified scheme for PEC processing and that some processing steps for generating print data have been omitted for clarity.

The keep-wet pattern data represents a pseudo random pattern of dots which is superimposed on the printed image. The keep-wet pattern ensures that each nozzle of the printhead 20 is fired within a predetermined period of time, which is generally less than the decap time of that nozzle. The keep-wet pattern therefore ensures that each nozzle of the printhead stays properly hydrated during a print job, even if the printed image does not demand firing of that nozzle and there has been no maintenance intervention.

Figure 3:
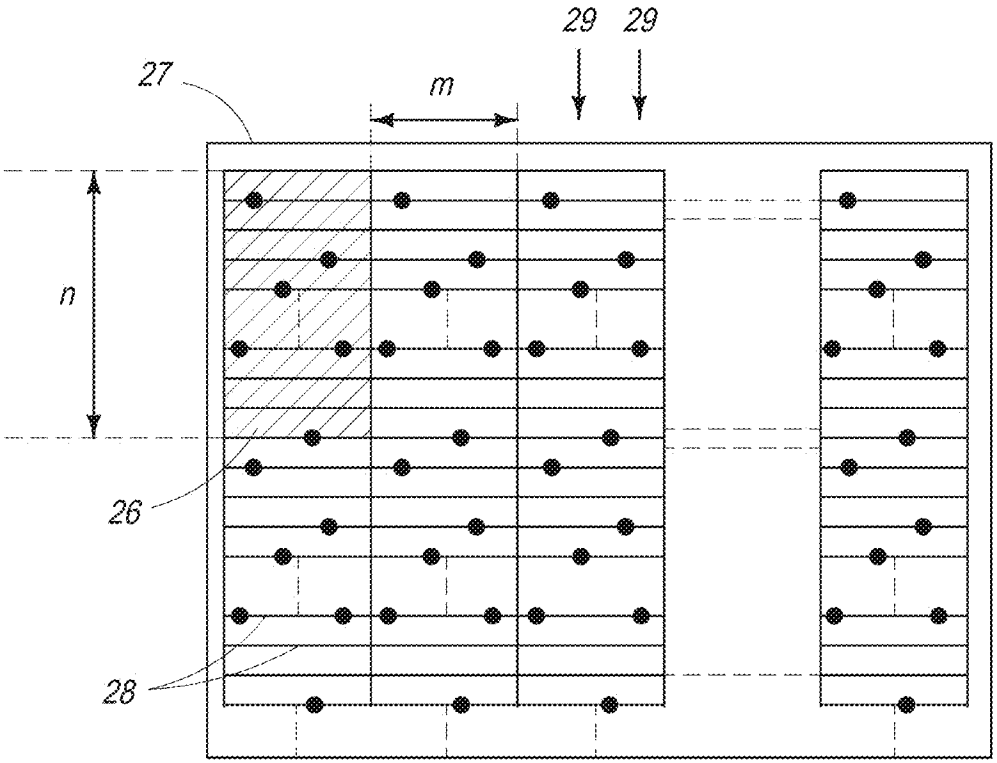
FIG. 3 shows schematically a page tiled with a keep-wet pattern based on a unit cell.

The pseudo random pattern of dots in the keep-wet pattern of each ink plane may be based on a unit cell (e.g. a rectangular tile), which is repeated both across and down the print media. For example, and referring to FIG. 3, each unit cell of the keep-wet pattern for a particular ink channel may be comprised of am x n rectangular cell 26, which is tiled over a page 27. The number of rows n (representing the height of the cell) may be in the range of 200 to 100,000 lines of print and the number of columns m (representing the width of the cell) may be in the range of 100 to 5,000 nozzles. In FIG. 3, the lines of print are schematically represented as lines 28, while the nozzles are schematically represented as arrows 29 (only two shown for clarity).

It will be appreciated the unit cell 26 may have any suitable shape (e.g. hexagonal, triangular etc) or dimension. However, relatively larger cells 26 provide a greater degree of pseudo randomness in the keep-wet pattern and lower overall visibility.

In order to randomize the keep-wet pattern further, a different offset may be applied to the keep-wet pattern on sequential pages so that the same keep-wet pattern is not tiled across each printed page in a sequence. The offset helps to remove repetition artifacts which may be visible in collated documents e.g. a dot appearing at the same position at an edge of every page. The offset is typically applied by the PEC 12 before merging the keep-wet pattern data with the first print data. The offset may be a simple instruction to advance the keep-wet pattern by p row(s) and/or q column(s) for every printed page, where p<n and q<m. Typically, p and q are each independently integers of 1 to 50.

Self-evidently, a drawback of printing the keep-wet pattern is a loss of print quality and it is, therefore, important to ensure that the visibility of the keep-wet pattern is minimized as far as possible.

The first aspect of the present invention enables the keep-wet pattern for each ink plane of the printhead to be tailored to a particular print job. Typically, the printer driver 10 determines a keep-wet pattern suitable for each ink plane based on one or more input parameters and sends appropriate keep-wet pattern data to the PEC 12. The printer driver 10 typically has an algorithm for determining the most appropriate combination of keep-wet patterns for the ink planes by weighting the various input parameters accordingly. As described above, in an alternative system architecture, determination of the keep-wet pattern data may be performed entirely by the PEC 12 in the printer 4.

Some of the parameters that may be used for determining the keep-wet pattern for each ink plane are discussed in detail below:

(1) Position of Ink Plane in Printhead

The position of the ink plane in the printhead determines, to a large extent, the local dehydrating environment of the ink plane and, therefore, the frequency of keep-wet ejections required. Typically, the ink plane furthest upstream in the printhead is in the most dehydrating environment as a result of the airflow experienced by the printhead and, therefore, requires a more frequent keep-wet pattern than the downstream ink planes. This is discussed in more detail below.

(2) Print Speed

The print speed is directly related to the speed of airflow experienced by the printhead. With higher print speeds, the speed of the airflow generated by the moving print media is higher and this has a greater dehydrating effect on the nozzles.

(3) Type of Ink

The color of ink is an important factor in determining an appropriate keep-wet pattern. For example, the keep-wet pattern is most visible with high luminance inks, such as black and least visible with low luminance inks, such as yellow. Therefore, a higher frequency keep-wet pattern is usually more tolerable in a yellow ink plane than a black ink plane. Indeed, yellow keep-wet patterns are virtually invisible, even at relatively high keep-wet frequencies.

Furthermore, some inks intrinsically have different dehydration characteristics than other inks and this is a fundamental criterion for determining an appropriate keep-wet pattern for a particular ink plane. For example, inks having a relatively high colorant loading tend to suffer more from dehydration effects than inks having a relatively low colorant loading. Of course, in a monochrome printhead, where all ink planes eject the same ink, the intrinsic dehydration characteristics of the ink will be the same in each ink plane of the printhead.

(4) Type of Print Media

Keep-wet patterns are usually less visible when printed on plain print media and more visible when printed on glossy print media.

(5) Length of Print Job

Dehydrating effects tend to increase over time, rather than reach a point of equilibration. Therefore, the length of the print job is an important parameter for determining an appropriate keep-wet pattern. Generally, it is undesirable for a long print run to have varying print quality, so the keep-wet pattern should be determined based on the greatest anticipated dehydrating environment, which will usually be at the end of the print run.

(6) Ambient Humidity

Ambient humidity may be measured using an appropriate humidity sensor on the printer and feeding back ambient humidity data to the printer driver. If the printer is positioned in a relatively humid environment, then a less frequent keep-wet pattern will be required compared to a relatively dry environment.

(7) Ambient Temperature

Ambient temperature may be measured using a temperature sensor on the printer and feeding back ambient temperature data to the printer driver. If the printer is positioned in a relatively cool environment, then a less frequent keep-wet pattern will be required compared to a relatively warm environment.

(8) Image Content

Ideally, the keep-wet dots should be coincident with the image, as far as possible, so that they have minimal effect on print quality. Likewise, printing high luminance (black) keep-wet dots on areas of low luminance in the image should be avoided as far as possible. Accordingly, the determination of the most appropriate keep-wet pattern for each ink plane may take into account the image data. For example, if the image contains regularly repeating blocks of color, then a keep-wet pattern coincident with these repeating blocks of color may be most appropriate.

(9) Optical Interference

Some or all of the ink planes of the printhead typically eject different keep-wet patterns. Visibility of the combined keep-wet patterns may be inadvertently increased if there are any optical interference effects (e.g. Moire interference effects) between the various keep-wet patterns. Therefore, the selected keep-wet patterns for the ink planes of the printhead should preferably be orthogonal in the sense that they produce minimal optical interference effects when printed together on the print media. Usually, the keep-wet patterns are selected to minimize any dot-on-dot printing from the different keep-wet patterns.

(10) Minimum Print Quality Threshold

Each print job may have a minimum print quality threshold which is set by the end user. Although maximizing print quality is paramount, some end uses may have different print quality criteria to others. This, in turn, affects the keep-wet patterns available for use. In some circumstances, it may be necessary to change other print parameters (e.g. print speed or length of print job) so that the keep-wet pattern can be incorporated within acceptable print quality limits.

From the foregoing, it will be appreciated that the keep-wet pattern for each ink plane of the printhead 4 may be tailored to provide an overall printed keep-wet pattern, which has minimum visibility.

Keep-Wet Frequency Highest in Upstream Ink Plane

A printhead employed in connection with the present disclosure typically comprises a plurality of ink planes. Each ink plane comprises one or more nozzle rows, with each nozzle in one ink plane being supplied with the same ink. For example, a Memjet® printhead comprises a pair of nozzle rows per ink plane, which are supplied with the same ink—one nozzle row prints 'even' dots and the other nozzle row prints 'odd' dots to make up a line of print for one ink plane.

The plurality of ink planes may be supplied with the same ink, all different inks, or at least one same ink and at least one different ink. For example, in a printhead having five ink planes, all five ink planes may be supplied with the same ink to provide a monochrome printhead (e.g. CCCCC, MMMMM, YYYYY, KKKKK etc.). Alternatively, only some of the ink planes may be supplied with the same ink (e.g. CMYKK, CCMMY etc). Alternatively, each ink plane may be supplied with a different ink (e.g. CMYK(IR) or CMYKS, where IR is an infrared ink and S is a spot color, such as khaki, orange, green, metallic inks etc).

With a fixed or stationary inkjet printhead, each ink plane of the printhead is positioned relatively upstream or downstream with respect to the media feed direction. The present inventors have found that the relative positioning of each ink plane in a fixed inkjet printhead has a marked effect on the local humidity of that ink plane relative to the other ink planes in the printhead during printing. Generally, the ink plane positioned furthest upstream with respect to the media feed direction is observed to be a in a relatively more dehydrating environment (i.e. less humid) than other ink planes in the printhead.

Figure 4:
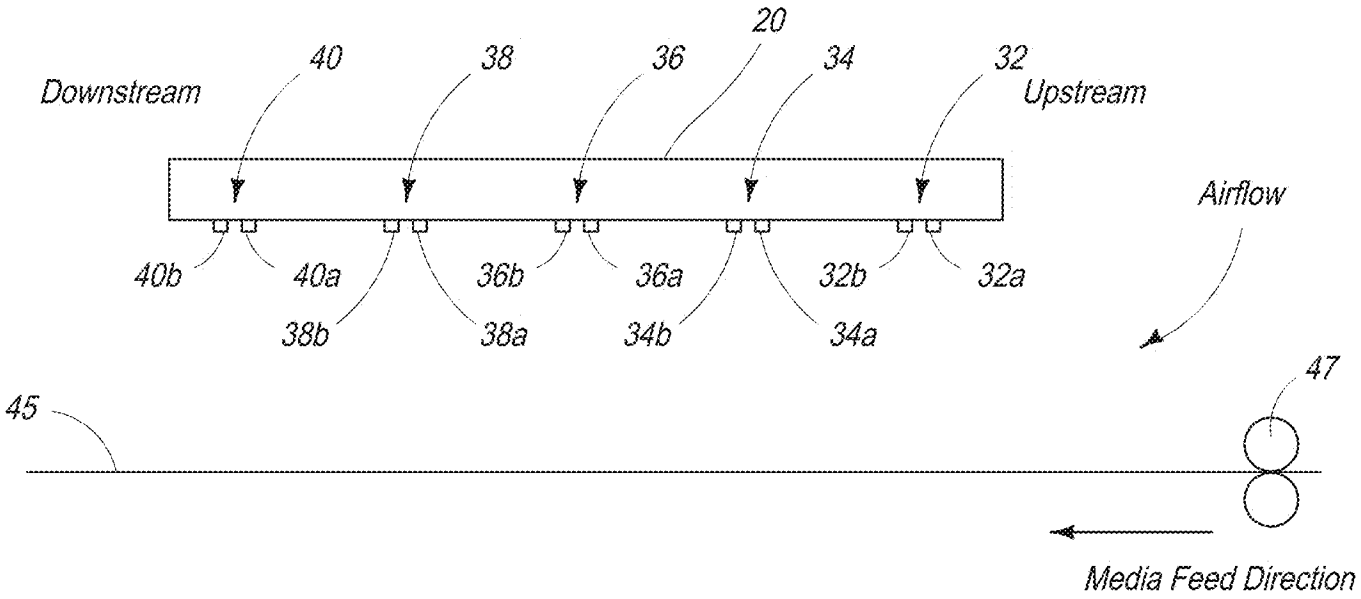
FIG. 4 is a schematic side view of a printhead having upstream and downstream ink planes.

Referring to FIG. 4, there is shown schematically a side view of the inkjet printhead 20 comprising five ink planes (32, 34, 36, 38 and 40), each comprising a pair of nozzle rows (32A & 32B, 34A & 34B, 36A & 36B, 38A & 38B and 40A & 40B). The ink planes are separated from each by a distance in the range of 50 to 100 microns.

A print medium 45 is fed in a media feed direction (right to left as shown in FIG. 4) by a media feed mechanism 47, which may take the form of a pair of opposed rollers gripping the print medium in a nip defined therebetween. The media feed direction therefore defines an upstream side and a downstream side of the printhead 20.

The motion of the print medium 45 in the media feed direction generates an airflow in a corresponding direction, as shown in FIG. 4. The speed of this airflow depends on the speed of the print medium, and to some extent, the type of print medium. For example, a continuous web will tend to generate a higher airflow than printing onto discrete sheets of print media.

As a consequence of this airflow, the ink plane 32 furthest upstream in the printhead 20 is positioned in the relatively most dehydrating environment compared to the other ink planes 34, 36, 38 and 40. The ink plane 32 is most exposed to the airflow, whereas the downstream ink planes 34, 36, 38 and 40 enjoy a degree of shielding from this dehydrating airflow by virtue of a stream of ink droplets ejected from nozzle rows 32A and 32B.

It is desirable for the printhead 20 to eject the minimum required frequency of keep-wet drops in order to maintain each nozzle of the printhead sufficiently hydrated during a print job. Any keep-wet drops which are excess to requirements are not only wasteful of ink, but more importantly, reduce print quality unnecessarily.

From the foregoing, it will be apparent that the minimum keep-wet frequency required for ink plane 32 will be higher than the minimum keep-wet frequency required for the other ink planes 34, 36, 38 and 40. This observation may be used in both monochrome and multicolor printheads to minimize the overall visibility of keep-wet patterns by ensuring only a minimum required keep-wet frequency for each ink plane.

Moreover, in a multicolor printhead, supplying a low luminance color, such as yellow, to the furthest upstream ink plane 32 advantageously minimizes the visibility of the relatively high frequency keep-wet pattern ejected from this ink plane. In a typical CMYK ink set, yellow has by far the lowest luminance compared to other colors. (The nominal luminances of CMYK inks on white paper are as follows: C (30%), M (59%), Y (11%) and K (100%)). Therefore, by supplying yellow ink to the furthest upstream ink plane 32, the perceived visibility of the overall keep-wet pattern ejected by all color planes can be significantly reduced.

As discussed above, the furthest upstream ink plane 32 is positioned in a locally most dehydrating environment of the printhead 20, because it does not benefit from any shielding from the airflow. Aside from the shielding effect of upstream ink plane(s), a secondary factor determining local humidity of a particular ink plane is the number of neighboring ink planes. For example, in FIG. 4, ink planes 34, 36 and 38 each have a pair of neighboring ink planes, whereas ink planes 32 and 40 only have one neighboring ink plane. Neighboring ink planes tend to increase the local humidity of an ink plane sandwiched therebetween. Accordingly, ink plane 40 positioned furthest downstream in printhead 20 is positioned in a relatively more dehydrating environment than ink planes 34, 36 and 38, but in a relatively less dehydrating environment than ink plane 32. Consequently, the relative minimum keep-wet frequencies of the ink planes for the printhead 20 may be in the order: ink plane 32 >ink plane 40 >ink planes 34, 36 and 40

Since ink planes 34, 36 and 40 are positioned in the least dehydrating local environment, it is advantageous to supply the highest luminance ink(s) (typically black) to these middle ink planes in order to minimize visibility of keep-wet patterns.

In light of the foregoing, in a Memjet® printhead having five ink planes supplied with CMYK inks, an advantageous plumbing arrangement may be Y-K-M-K-C or Y-K-C-K-M, with yellow (Y) furthest upstream and black (K) occupying middle ink planes.

Multiple Aligned Monochrome Printheads

The principles discussed above in connection with ink planes of a single printhead 20, may be applied in a printer comprised of a plurality of monochrome printheads aligned in a media feed direction.

Figure 5:
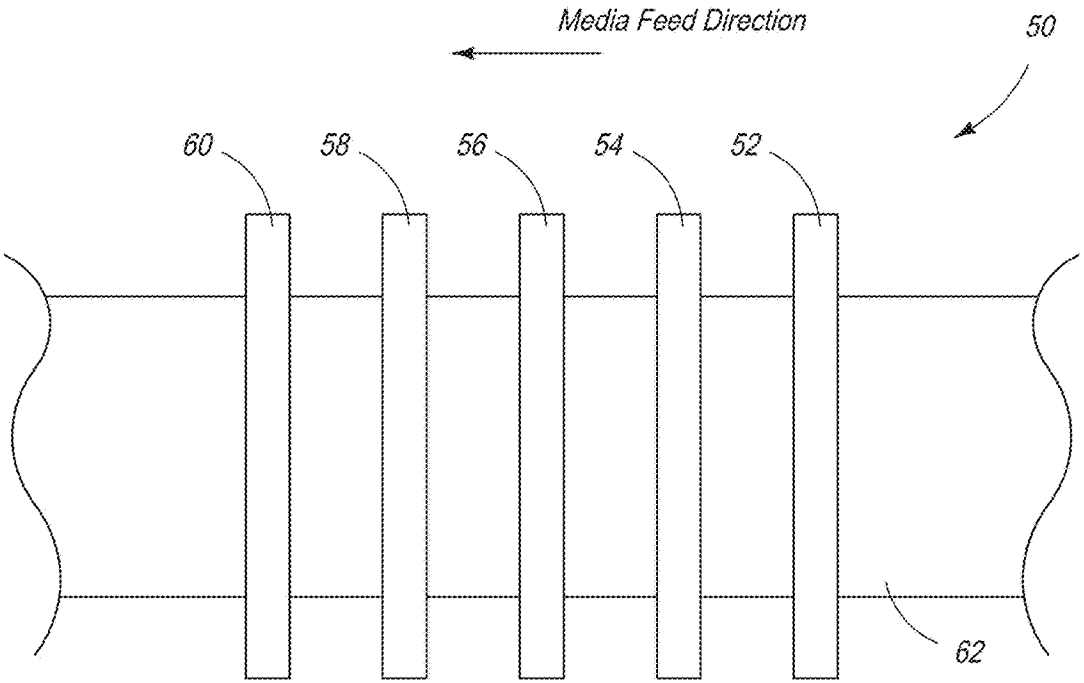
FIG. 5 is a schematic plan view of a printer comprising multiple aligned monochrome printheads.

FIG. 5 shows schematically in plan view a high-speed web printer 50 comprised of five fixed inkjet printheads 52, 54, 56, 58 and 60, which are aligned with each other in a media feed direction. The printheads are spaced apart from each by a distance in the range of 3 to 20 cm. Each printhead is a monochrome printhead, which ejects a single color of ink from a plurality of ink planes. For example, the five monochrome printheads 52, 54, 56, 58 and 60 may eject CMYK inks (e.g. CMYKK) or CMYKS inks.

A web of print media 62 is fed past each of the printheads in the media feed direction as shown using a suitable media feed mechanism. This type of printer, which is described in more detail in US 2012/0092403 (incorporated herein by reference), is capable of printing at very high speeds, such as speeds greater than 0.2 meters per second, greater than 0.5 meters per second, or greater than 1 meter per second.

By extension of the principles discussed above in connection with FIG. 4, the printhead 52 positioned furthest upstream with respect to the media feed direction is in the relatively most dehydrating environment compared to the other printheads 54, 56, 58 and 60. Therefore, the printhead 52 generally requires a higher average keep-wet frequency than the other printheads. (Note that individual ink planes in each printhead may have different keep-wet frequencies, but the average minimum keep-wet frequency across all ink planes in printhead 52 is higher than the average minimum keep-wet frequency for the other printheads 54, 56, 58 and 60). Furthermore, it is advantageous to supply printhead 52 with the lowest luminance ink (usually yellow) so that the keep-wet pattern ejected from printhead 52 has minimal visibility—the lower luminance of yellow ink effectively compensates for the higher average keep-wet frequency required in printhead 52.

Similarly, it is advantageous to supply the highest luminance ink to one or more of the middle printheads 54, 56 and 58. These printheads benefit, at least to some extent, from the upstream shielding effect of printhead 52 as well as the humidifying effect of two neighboring printheads.

Since the printhead spacing in the printer 50 is of the order of centimeters, as opposed to the micron-scale separation of ink planes within the printhead 20, the local humidifying effects in the printer 50 will be less pronounced than those described above in connection with FIG. 4. Nevertheless, there is a demonstrable advantage in positioning the yellow printhead 52 furthest upstream in the printer 50 and this has a direct effect in improving print quality via minimization of keep-wet frequencies. Keep-wet patterns are virtually inevitable for maintaining adequate hydration in inkjet web printers, where there is no opportunity for between-page spitting and less opportunity for maintenance interventions compared to desktop sheet-fed printers. Accordingly, the present invention is most advantageous when employed in connection with inkjet web printers, such as the printer 50 shown in FIG. 5.

It will, of course, be appreciated that the present invention has been described by way of example only and that modifications of detail may be made within the scope of the invention, which is defined in the accompanying claims.

The invention claimed is:

1. A method of printing an image from a printer having a plurality of ink planes, each ink plane comprising one or more rows of nozzles supplied with the same ink, the method comprising the steps of:

printing the image; and simultaneously printing a keep-wet pattern together with the image, wherein:

the keep-wet pattern comprises a pseudo-random pattern of dots printed at a frequency sufficient to ensure that each nozzle of the printhead is fired within a predetermined period of time which is less than a decap time of said nozzle; and the keep-wet pattern for each ink plane is determined using one or more input parameters selected from the group consisting of:

a position of each ink plane in the printer;

a print speed of the print job;

a type of ink printed from each ink plane;

a type of print medium;

a length of the print job;

an ambient humidity;

an ambient temperature;

the image content;

optical interference between keep-wet patterns printed from each ink plane; and a minimum print quality threshold.

2. The method of claim 1, wherein at least one ink plane ejects a different keep-wet pattern than at least one other ink plane of the printer.

3. The method of claim 1, wherein a printer controller retrieves keep-wet pattern data for the keep-wet pattern.

4. The method of claim 3, wherein the printer controller comprises a memory storing a plurality of different keep-wet pattern data, and wherein the printer controller retrieves the keep-wet pattern data for a print job from the memory.

5. The method of claim 1, wherein the keep-wet pattern data for each ink plane is determined using at least the following two parameters:

a position of each ink plane in the printer relative to the media feed direction; and a type of ink printed from each ink plane.

6. The method of claim 1, wherein the keep-wet pattern for each ink plane is determined by an algorithm, the algorithm weighting said one or more parameters.

7. The method of claim 6, wherein printer firmware or a printer driver comprises the algorithm.

8. The method of claim 1, wherein the pseudo-random pattern of dots defining the keep-wet patterns for different ink planes are not printed dot-on-dot.

* * * * *